US010350449B2

(12) United States Patent
Abrahams

(10) Patent No.: US 10,350,449 B2
(45) Date of Patent: Jul. 16, 2019

(54) YOGA BLOCKS WITH CUSTOMIZABLE STORAGE

(71) Applicant: Matthew Abrahams, Portland, OR (US)

(72) Inventor: Matthew Abrahams, Portland, OR (US)

( * ) Notice: Subject to any disclaimer, the term of this patent is extended or adjusted under 35 U.S.C. 154(b) by 33 days.

(21) Appl. No.: 15/465,103

(22) Filed: Mar. 21, 2017

(65) Prior Publication Data

US 2018/0272180 A1 Sep. 27, 2018

(51) Int. Cl.

*A63B 21/00* (2006.01)
*A63B 71/00* (2006.01)
*A63B 23/04* (2006.01)

(52) U.S. Cl.

CPC ..... *A63B 21/4037* (2015.10); *A63B 23/0458* (2013.01); *A63B 71/0036* (2013.01); *A63B 2209/08* (2013.01); *A63B 2225/685* (2013.01)

(58) Field of Classification Search

CPC ..... A45C 2005/037; A45C 13/1069; B65D 5/6697; A63B 6/00; A63B 21/00047; A63B 21/0005; A63B 21/00054; A63B 21/002; A63B 21/0023; A63B 21/0605; A63B 21/068; A63B 21/4023; A63B 21/4027; A63B 21/4037; A63B 23/04; A63B 23/0405; A63B 23/0458; A63B 26/00; A63B 26/003; A63B 71/0036; A63B 71/0054; A63B 2071/0063; A63B 2071/0072; A63B 2071/0081; A63B 2071/009; A63B 2209/08; A63B 2209/10; A63B 2210/00; A63B 2210/50; A63B 2225/09; A63B 2225/093; A63B 2225/68; A63B 2225/685; A63B 2225/687

See application file for complete search history.

(56) References Cited

U.S. PATENT DOCUMENTS 2,318,608 A * 5/1943 Hempel ..... E05D 5/02 220/829
3,152,716 A * 10/1964 Feldhahn ..... A45C 13/005 16/320
4,106,597 A * 8/1978 Shook ..... A45C 11/20 190/110
5,096,030 A * 3/1992 Espinosa ..... A45C 5/00 190/108
5,555,671 A * 9/1996 Voight ..... A01K 97/06 206/315.11
5,897,209 A * 4/1999 Roegner ..... A45C 3/00 150/113
6,796,344 B2 9/2004 Chen et al.
7,318,794 B2 1/2008 Davies
8,646,971 B2 2/2014 Doyle (Continued)

*Primary Examiner* — Gary D Urbiel Goldner
(74) *Attorney, Agent, or Firm* — Mohr Intellectual Property Law Solutions, PC

(57) ABSTRACT

A yoga block having two halves is adapted for storage whereby at least one of the two halves includes a cavity capable of receiving a flexible pouch and holding the flexible pouch securely. In some examples, the yoga block includes a cavity in each of the two halves for storing a flexible pouch within each of the two halves. In some further examples, the yoga block includes fasteners for securing each flexible pouch within each of the two halves, and hinges configured to be hidden when the two halves of the yoga block are in a closed position.

6 Claims, 6 Drawing Sheets

(56) References Cited

U.S. PATENT DOCUMENTS

| | | | | |
|---|---|---|---|---|
| D728,358 | S * | 5/2015 | Belamich | A63B 69/0002 D9/420 |
| 9,072,653 | B2 * | 7/2015 | Nemard | A61J 1/03 |
| 9,457,253 | B1 * | 10/2016 | Rodriguez | A63B 69/0002 |
| 9,526,309 | B2 * | 12/2016 | Huyke-Phillips | D05B 23/00 |
| 2009/0023563 | A1 | 1/2009 | Liang | |
| 2010/0147861 | A1 | 6/2010 | Andochick | |
| 2010/0181227 | A1 * | 7/2010 | Tolkowsky | A45C 11/16 206/755 |
| 2011/0244758 | A1 * | 10/2011 | Boatright | A41C 3/0035 450/89 |
| 2015/0258363 | A1 | 9/2015 | Kampinski | |
| 2016/0100924 | A1 * | 4/2016 | Wilson | A61C 19/02 206/63.5 |
| 2016/0105050 | A1 * | 4/2016 | Chan | H02J 7/0044 320/114 |
| 2017/0188674 | A1 * | 7/2017 | Dotey | A45C 7/0095 |

* cited by examiner

YOGA BLOCKS WITH CUSTOMIZABLE STORAGE

BACKGROUND

The present disclosure relates generally to devices useful for various health and fitness routines and discipline. In particular, yoga blocks, useful in performing various yoga poses and practices, that include storage for personal effects are described.

Yoga is a popular activity to engage in to improve both physical and mental health, as well as improve flexibility. Often yoga blocks are used in practice, as props to aid alignment or to support body parts to facilitate poses, or as a makeshift seat during meditation to ensure a seated posture with an upright spine. Further, yoga blocks are frequently used for other types of exercise beyond yoga, and so must be sturdy enough to support a user's weight in various orientations (both the block and the user). Such blocks are typically made from a rigid or solid foam, or on occasion from materials such as wood, cork, or plastic. Yoga blocks are typically the size of a large jewelry box, approximately 9"×4"×3" in most implementations, but must be of sufficiently sturdy construction to meet the intended uses described above, which exceeds the durability of a typical jewelry or storage box.

However, known yoga blocks are not entirely satisfactory for the range of applications in which they are employed. Many people enjoy practicing yoga in a studio, where instruction, an appropriate environment, and a sense of community are readily available. Yoga studios often supply yoga blocks for patrons; however, these blocks are not always cleaned after every use, and consequently may pick up odors from sweat and otherwise be unsanitary. Furthermore, some yoga studios are sparsely equipped compared to gyms, lacking locker or other storage facilities for patrons' personal effects. In such a situation, a patron is forced to either leave their personal items in their vehicle or other location out of sight, where valuables become an easy target for theft or the cause of vehicle break-ins, or bring their items into the studio with them, which can create clutter and/or the possibility of breakage if a patron (or any other patron) is not careful. Also, different patrons will need to bring different items with them into the studio, e.g. glasses, keys, phones, toiletries, etc. A yoga block is of a suitable size to store most personal effects such as a phone and/or wallet, yet many yoga blocks are typically solid, and incapable of storage.

There are known in the art yoga blocks that are hollow so as to accommodate storage of personal effects. However, as noted above, the types of personal effects may vary from patron to patron. A simple hollow block fails to provide adequate storage in the context of a yoga block that is subject to movement and potential drops. Some personal effects, such as jewelry, can be damaged if not secured properly, or become tangled or knotted. Other combinations of personal effects can cause damage when stored together in an unrestrained fashion. For example, if keys are stored unrestrained in a container with a smartphone—two common personal effects that most people own—the keys can cause damage to the finish and screen of the smartphone. It is thus preferable that personal effects be stored in a fashion that suitably separates and protects the various items.

Thus, there exists a need for yoga blocks that include storage to improve upon and advance the design of known yoga blocks. As a variety of items may need to be stored in a given block, it is desirable to allow a user to customize the type of storage offered by a particular block. Examples of new and useful yoga blocks including storage that relevant to the needs existing in the field are discussed below.

Disclosure addressing one or more of the identified existing needs is provided in the detailed description below. Examples of references relevant to yoga blocks with storage include the following references: U.S. Pat. Nos. 6,796,344, 7,318,794 and 8,646,971; and U.S. Patent Application Publications Nos. 2009/0023563, 2010/0147861 and 2015/0258363. The complete disclosures of the above patents and patent applications are herein incorporated by reference for all purposes.

U.S. Patent Application Publication No. 2015/0258363 to Kampinski discloses a yoga brick with an internal storage area and grip system that functions to secure the brick. The grip system includes two straps that lie in parallel grooves formed in the external surfaces of the brick, and are used to secure the brick in a closed configuration. The internal storage area can either include a stabilization means comprised of an interior container that is either permanently affixed within the internal storage area, or that fits snugly within the internal storage area and is held in place via friction from the snug fit. The configuration of the removable container is not discussed.

U.S. Pat. No. 7,318,794 to Davies discloses a yoga block system that includes a plurality of yoga blocks that can be releasably joined together along a common face to form a larger structure. At least one of the blocks is hollow, and allows a user to gain access to the interior for storage of items. As with Kampinski, the internal configuration of the block is not discussed.

SUMMARY

The present disclosure is directed to a yoga block with storage. According to one aspect of the invention, a yoga block with storage comprises a first block half that possesses a cavity; and a second block half, wherein the first block half possesses one or more attachment points located within the cavity, the first block half and second block half are attached together using one or more hinges that are hidden when the first block half and second block half are closed together, and the first block half removably secures to the second block half when the two block halves are brought together.

In one embodiment, the first block half removably secures to the second block half by way of a magnet positioned in one of the block halves, and a corresponding piece of magnetically attractive material located in the opposing block half.

In another embodiment, a flexible pouch is provided that is equipped with one or more attachment points disposed upon the flexible pouch such that each of the one or more attachment points upon the flexible pouch corresponds in location to one of the one or more attachment points located within the cavity, so that the flexible pouch is removably secured within the cavity by the interaction of the one or more attachment points upon the flexible pouch with the one or more attachment points located within the cavity.

In another embodiment, the second block half possesses a cavity, and further possesses one or more attachment points located within the second block half cavity.

In still another embodiment, a second flexible pouch is provided that is equipped with one or more attachment points disposed within the flexible pouch such that each attachment point in the second flexible pouch corresponds in location to one of the one or more attachment points located within the second block half cavity, so that the second flexible pouch is removably secured within the second block half cavity by the interaction of the one or more attachment points upon the second flexible pouch with the one or more attachment points located within the second block half cavity.

In yet another embodiment, the one or more attachment points located within the cavity and the second block half cavity are each comprised of a magnet, and the one or more attachment points located upon the flexible pouch and the second flexible pouch are each comprised of a magnetically attractive material.

In another embodiment the one or more attachment points located within the cavity are each comprised of a magnet, and the one or more attachment points located upon the flexible pouch are each comprised of a magnetically attractive material that is embedded within the flexible pouch.

In another embodiment each of the one or more attachment points located within the cavity further comprise either hook or loop material, and each of the one or more attachment points located upon the flexible pouch further comprise either loop or hook material, complementary to and engaging with the hook or loop material comprising each of the one or more attachment points located within the cavity.

In still another embodiment each of the one or more attachment points located within the cavity further comprise a snap, a plurality of straps, or a plurality of ties.

According to a second aspect of the disclosed invention, a yoga block with storage comprises a first block half, further comprising a cavity disposed within the first block half; and securing means disposed within the first block half cavity; a second block half; a hinging means that attaches the first block half to the second block half such that the two halves can pivot relative to each other to open or close the yoga block; and latching means for securing the first block half and second block half together so as to retain the yoga block in a closed configuration.

In one embodiment a pouch sized to fit within the first block half cavity is provided, possessing securing means complementary to and attaching to the securing means disposed within the first block half cavity.

In another embodiment the second block half further comprises a second cavity disposed within the second block half; and securing means disposed within the second cavity.

In yet another embodiment a first pouch sized to fit within the first block half cavity is provided, which possesses securing means complementary to and attaching to the securing means disposed within the first block half cavity; and a second pouch sized to fit within the second block half cavity is further provided, possessing securing means complementary to and attaching to the securing means disposed within the second block half cavity.

In still another embodiment the first block half is substantially taller in proportion compared to the second block half.

According to a third aspect of the disclosed invention a yoga block with storage comprises a first block half; the first block half further comprising a first block half cavity disposed within the first block half; a plurality of magnets disposed within the first block half cavity; and at least one magnet disposed within a first block half first edge and a second block half, the second block half further comprising a second block half cavity disposed within the second block half; a plurality of magnets disposed within the second block half cavity; and at least one magnetically attractive piece disposed within a second block half first edge so as to come into proximity with the at least one magnet disposed within the first block half first edge when the first block half and second block half are closed together, and wherein the first block half and second block half are attached to each other by at least one hinge that connects to a first block half second edge and a second block half second edge, the first block half second edge being disposed opposite from the first block half first edge and the second block half second edge being disposed opposite from the second block half second edge, and the first block half and second block half can be retained in a closed configuration by the interaction between the at least one magnet disposed within the first block half first edge and the at least one magnetically attractive piece disposed within the second block half first edge.

According to one embodiment of the third aspect a flexible pouch sized to fit within the first block half cavity is further provided, the flexible pouch possessing a plurality of magnetically attractive pieces arranged so as to engage with the plurality of magnets disposed within the first block half cavity and thereby be removably secured within the first block half cavity, the flexible pouch further comprising one or more securing flaps arranged in a first configuration.

According to another embodiment a second flexible pouch sized to fit within the second block half cavity is provided, the second flexible pouch possessing a plurality of magnetically attractive pieces arranged so as to engage with the plurality of magnets disposed within the second block half cavity and thereby be removably secured within the second block half cavity, the second flexible pouch further comprising one or more securing flaps arranged in a second configuration that differs from the first configuration.

According to yet another embodiment the at least one hinge is configured to he hidden from the exterior of the yoga block when first block half and second block half are in a closed configuration.

According to still another embodiment the first block half and second block half are substantially identical in size and configuration.

According to another embodiment the first block half and second block half are constructed from wood, metal, plastic, or composite materials.

DETAILED DESCRIPTION

Figure 1:
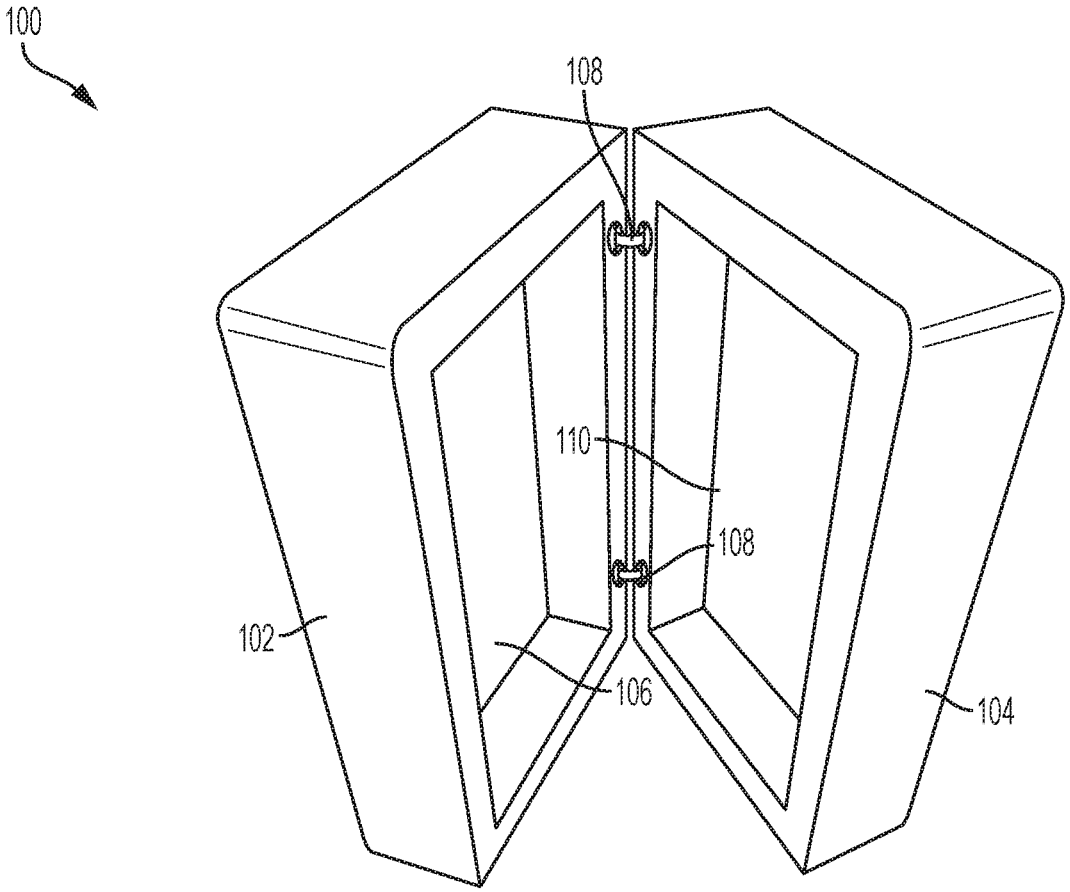
FIG. 1 is a perspective view of a first example of a yoga block with storage, depicting the block in a partially open configuration.

The disclosed yoga blocks with storage will become better understood through review of the following detailed description in conjunction with the figures. The detailed description and figures provide merely examples of the various inventions described herein. Those skilled in the art will understand that the disclosed examples may be varied, modified, and altered without departing from the scope of the inventors described herein. Many variations are contemplates for different applications and design considerations; however, for the sake of brevity, each an every contemplated variation is not individually described in the following detailed description.

Throughout the following detailed description, examples of various yoga blocks with storage are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1-6B, one possible embodiment of a yoga block with storage, yoga block 100, will low be described. Yoga block 100 functions to serve as both an exercise block useful while the user engages in various yoga positions, as well as to provide storage for various items such as personal effects that, due to the function of yoga block 100 as an exercise, are kept in close vicinity to the user. The reader will appreciate from the figures and description below that yoga block 100 addresses shortcomings of conventional yoga blocks.

For example, yoga block 100 provides a space for safe, secure and discreet storage of personal items such as watches, jewelry, wallets, keys and phones during a yoga class or studio session. Where a studio provides yoga blocks 100, patrons of the studio are thereby supplied with a storage option that helps to minimize the risk of a vehicle break-in, as well provide a place for storage that is both proximate to the patron yet out of the way of possible damage that could occur if left in the open within the studio, as well as preventing clutter of studio.

Further, where a yoga block 100 is personal to a user, hygiene is improved compared to using shared yoga blocks. Yoga block 100 can be equipped with a variety of internally secured storage pouches that can be selected by a user to customize the nature of the internal storage as well as to hold internally stored items in a secure fashion, so that movement of yoga block 100 does not result in the stored items tumbling against each other, and thus delicate items are held safe. For example, if keys are placed relative to a phone such that the keys can tumble and rub against the phone, the phone's display and/or case can be easily marred or scratched. Likewise, jewelry such as bracelets, earrings, or necklaces could become tangled in an environment where they are tossed around; storage pouches can be used to secure items against each other and hold them fast while yoga block 100 is moved during exercise.

Yoga block 100 includes a first block half 102 that possesses a cavity 106, and a second block half 104 that possesses a cavity 110, wherein the first block half possesses one or more attachment points 112 located within cavity 106, and the second block half 104 possesses one or more attachment points 114 located within cavity 110. First block half 102 and second block half 104 are attached together using one or more hinges 108 that are hidden when first block half 102 and second block half 104 are closed together. First block half 102 removably secures to second block half 104 when the two block halves are brought together via an attachment mechanism.

As can be seen in FIG. 1, the body of yoga block 100 is split essentially in half, to form first block half 102 and second block half 104. Block halves 102 and 104 can be constructed using a variety of known construction methods, and from a variety of materials. In some examples, yoga block 100 is first built as a single, hollow which is then split in half. Construction techniques may include carpentry skills where yoga block 100 is made of wood, using well-known joinery techniques, adhesives, mechanical fasteners, CNC routing or lathing, or a combination of any of the foregoing. Where plastic is used, construction techniques may include injection molding, casting, 3D printing, or any other suitable technique known in the art for fabricating plastic components. For a metal implementation, welding of panels, cast, mechanical fastening, or adhesives may be employed, or any other suitable method of fabrication now known or later developed. Furthermore, yoga block 100 could be fabricated from other materials such EVA or another type of foam, rubber or composites, or a combination of any of the foregoing materials, or any other suitable material now known or later developed. Where yoga block 100 is manufactured from several materials, it is preferably constructed with an inner rigid material to form a structure or skeleton of sorts, and then encased with a softer outer material to provide cushioning to the user. The materials and construction techniques listed herein are examples only, and are in no way intended to be limiting. The exterior of yoga block 100 may further be made decorative, so long as the exterior finish is sufficient durable to withstand the normal rigors imposed by a user during yoga.

Block halves 102 and 104 can be independently constructed, or can be formed by taking a hollow block and splitting it in two, using any well-known technique appropriate for the materials used to construct yoga block 100, such as a band saw, other type of saw, laser, water jet or other similar cutting device. Block halves 102 and 104 can be constructed from the same materials, or from different materials. Where block halves 102 and 104 are constructed separately, they can be manufactured using the same techniques described above in reference to a complete block that is split into two. Moreover, while block halves 102 and 104 are depicted as identical or mirror images in the figures, this need not be the case; block half 102 could be of a different size from block half 104. For example, one block half could be sized to be relatively shallow compared to the other half, similar to a lid on a jewelry box.

Into each block half 102, 104 is created a cavity 106, 110, respectively. In the preferred embodiment each cavity is sized such that the wall thickness of block halves 102 and 104 is approximately consistent throughout. Cavities 106 and 110 must be sized so that the resulting wall thickness of block halves 102 and 104 is sufficient to support the loads experienced by yoga block 100 while in use, without causing structural failure. A person skilled in the relevant art will appreciate that this thickness will depend at least partially on the type of materials used to fabricate yoga block 100.

Figure 2:
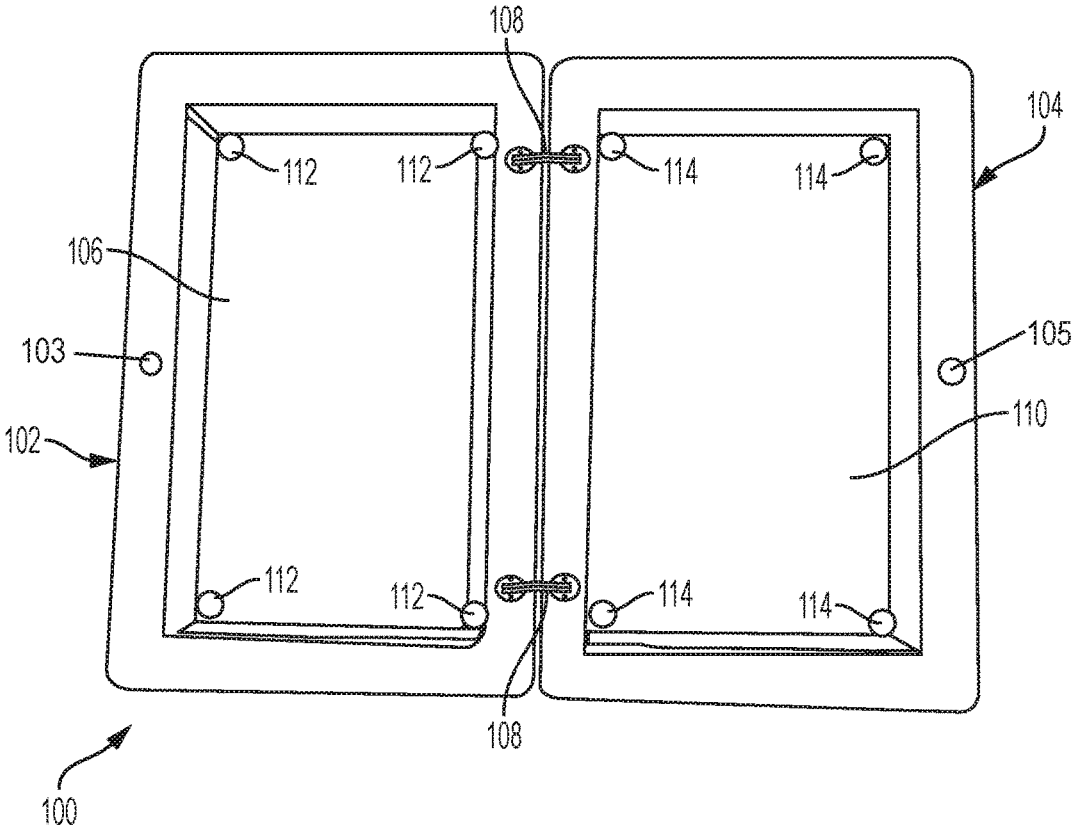
FIG. 2 is an overhead view of the yoga block with storage shown in FIG. 1 depicting it fully open so as to show the location of various internal pouch attachment points.

As shown in FIGS. 1 and 2, the sides of cavities 106 and 110 mirror the outer profile of block halves 102 and 104. In the figures, profile results in cavities 106 and 110 being substantially rectangular in shape. However, this is depicted for example only; cavities 106 and 110 could be sized irregularly, such as with curved or rounded sides, or in different shapes such as polygons, as may be required by the intended uses of yoga block 100. Moreover, it is not necessary that each block half 102 and 104 have a cavity; for example, first block half 102 may possess a cavity 106, while second block half 104 may not have a cavity, or vice versa.

Figure 3:
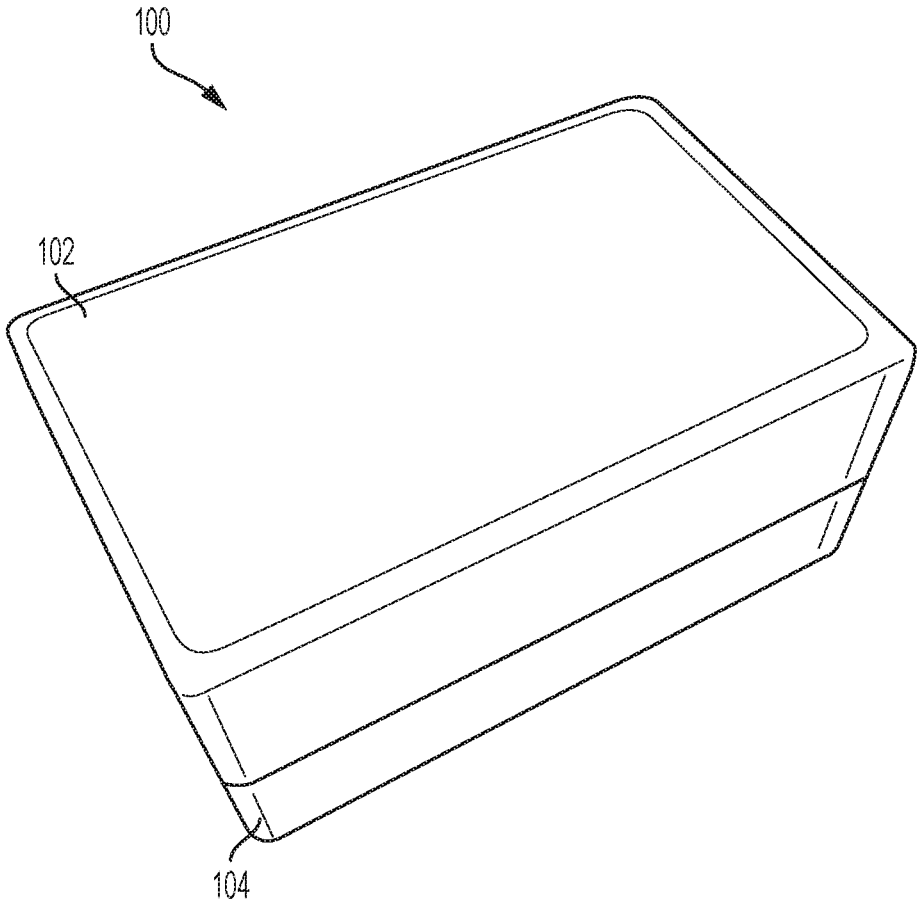
FIG. 3 is a perspective view of the yoga block with storage shown in FIG. 1, depicting it in a closed configuration.

First block half 102 and second block half 104 are secured by one or more hinges 108. As depicted in FIGS. 1 and 2, two hinges 108 are provided, although anywhere from one to multiple hinges 108 may be employed depending upon the construction of yoga block 100 and the nature of hinges 108 that are employed. In FIGS. 1 and 2, hinges 108 are preferably designed to be hidden within first block half 102 and second block half 104, so that when yoga block 100 is closed, the hinges are not visible; in this way no protrusions are presented when yoga block 100 is closed and in use that may snag upon the user. FIG. 3 depicts yoga block 100 in a closed position, and where hinges 108 are implemented as hidden hinges, the appearance on all sides will be as in FIG. 3. However, it should be understood that this is by example only; hinges 108 could be implemented using a mechanism that is visible from the exterior when yoga block 100 is closed, so long as hinges 108 do not pose a snag hazard or otherwise potentially interfere with the use of yoga block 100.

Turning to FIG. 2, yoga block 100 is presented in a fully open configuration. Again, hinges 108 are shown to be embedded within each of first block half 102 and second block half 104, and are configured to allow block halves 102 and 104 to open to approximately 180 degrees. However, this is not necessary; hinges that allow for less than 180 degrees of opening could be employed without departing from the disclosed invention. Hinges 108 further may be configured to allow block halves 102 and 104 to be separated. Hinges 108 are constructed using any materials and technology suitable to the applications of yoga block 100 described herein, and in the alternative to being positioned at separate points on block halves 102 and 104, could be implemented as a long strip that spans a section of each of first block half 102 and second block half 104. Such materials may include metal, wood, plastic, composites, or other materials of similar functionality now known or later developed.

FIG. 2 also depicts the attachment mechanism, with first attachment half 103 shown in first block half 102, disposed opposite to the side of hinges 108, and second attachment half 105 shown in second block half 104, likewise disposed opposite to hinges 108. In the preferred embodiment each of first attachment half 103 and second attachment half 105 allow yoga block 100 to be secured in a closed configuration without an appreciable gap between first block half 102 and second block half 104. One preferred implementation of the attachment mechanism is via magnets, with first attachment half 103 and second attachment half 105 each being comprised of a magnet that is embedded within the walls of each block half 102, 104 such that a face of each magnet sits flush with the edge of each block half. In such an implementation each magnet is disposed so that its complement in the opposing block half exposes a complementary pole, viz. if the magnet embedded in first block half 102 is disposed so that the north pole of the magnet is exposed, the magnet embedded in second block half 104 is disposed so that the south pole of the magnet is exposed, whereupon bringing the two block halves 102 and 104 together causes first attachment half 103 to be attracted to second attachment half 105, thereby causing yoga block 100 to be retained in a closed position.

It should be understood that magnets as described above is but one possible implementation for the attachment mechanism, and is not intended to be limiting. Other possible mechanisms may be employed, such as latches, pins, clasps, hooks, locks or any other means by which first block half 102 may be secured to second block half 104. Where the attachment mechanism employs a lock, yoga block 100 could allow for a measure of secure storage. Moreover, although a single attachment mechanism is depicted in FIG. 2 that is located substantially in the center of one side of each block half 102, 104, this is merely an example. Multiple attachment mechanisms could be deployed at various positions upon each block half 102 and 104 without departing from the disclosed invention. As with hinges 108, such variations on the attachment mechanism should be implemented with an eye to avoiding protrusions from the exterior surface of yoga block 100 so as to avoid a snag hazard. Furthermore, although first attachment half 103 and second attachment half 105 are depicted as round magnets, in keeping with the flexibility of possible mechanisms magnets of any shape or configuration may be employed.

Furthermore, as an alternative embodiment, hinges 108 could be replaced with attachment mechanisms, such as additional magnets in the location of each hinge. In such an implementation first block half 102 could be completely separated from second block half 104, and would be secured together entirely by the attachment mechanisms.

The body of yoga block 100, when closed, is of suitable dimensions to act as a yoga block; a possible example of these dimensions were recited above.

Returning to FIG. 2, in the bottom surface of cavity 106 are located a plurality of attachment points 112; likewise, the bottom surface of cavity 110 are located a corresponding plurality of attachment points 114. These attachment points 112 and 114 serve to secure a flexible pouch, which will be described further herein, within each respective cavity 106 and 110. Attachment points 112 and 114 may be implemented using magnets, either embedded or placed upon the surface, similar to those magnets used for first attachment half 103 and second attachment half 105. This is only one possible example; attachment points 112 and 114 could be implemented using other means to secure a flexible pouch, such as hook anal loop material, snaps, clasps, or any other similar means to secure a flexible pouch in a removable fashion.

Although each cavity 106 and 110 is depicted with four attachment points 112 and 114, respectively, in each corner of each cavity 106, 110 this should not be taken as limiting. More or less than four attachment points 112 and 114 may be employed, and attachment points 112 and 114 may be placed in different locations that where depicted in FIG. 2. Attachment points 112 and 114 also need not be identical with respect to each other; a variety of different attachment point types may be employed within a single cavity. Similarly, the configuration, arrangement, number and type of attachment points 112 in cavity 106 need not be identical to, but may vary from, the configuration, arrangement, number and type of attachment points 114 in cavity 110.

Figure 4:
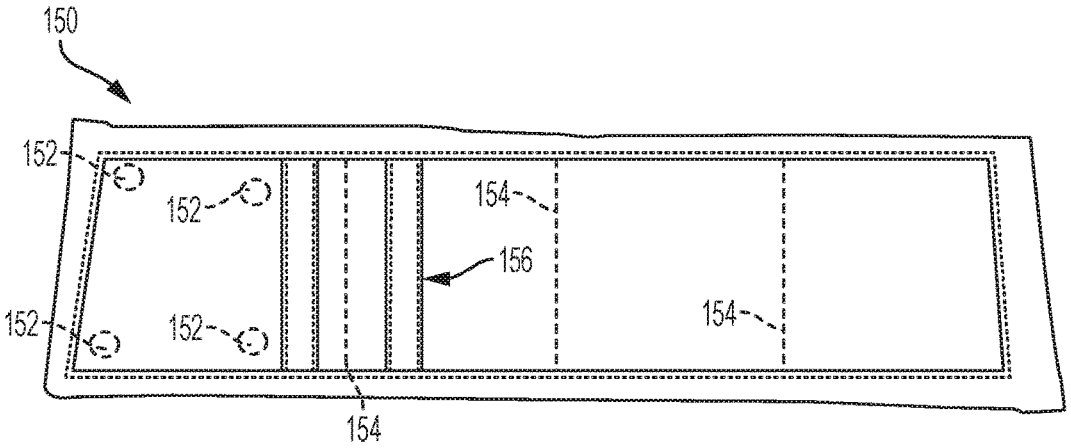
FIG. 4 is an offset frontal view of a first example of a storage pouch that is useful with the yoga block shown in FIG. 1, and that can be fit internally within the yoga block.

Turning to FIG. 4, one possible embodiment of flexible pouch 150 is depicted. Flexible pouch 150 includes attachment points 152, folds 154, and securing flaps 156. Attachment points 152 are configured and arranged to correspond to the attachment points located in at least one of cavities 106 or 110. Where attachment points 112 and 114 are configured identically and use identical mechanisms, flexible ouch 150 can be secured into either cavity 106 or 110. Likewise, each attachment point 152 must be implemented using mechanisms that correspond to the various attachment point mechanisms employed for attachment points 112 and 114.

Flexible pouch 150 is preferably constructed from material that, as the name implies, is flexible, such as fabric, canvas, plastic, leather, vinyl, rubber or other similar material that is sufficiently durable to retain the personal effects of a user of yoga block 100 without damaging them, or causing them to damage each other when yoga block 100 is in normal use. Flexible pouch 150 may further be constructed of a combination of materials, and may include a lining of different material such as microfiber or velvet for further protection of personal items.

As shown in FIG. 4, flexible pouch 150 is sized larger than the width of either cavity 106 or 110. Depending upon the material used to fabricate flexible pouch 150, the pouch can be configured in a first configuration with folds 154 where the material is intended to be folded in upon itself so as to reduce flexible pouch to a size that will fit within cavity 106 or 110, and position attachment points 154 appropriate to engage with attachment points 112 or 114. Other implementations of flexible pouch 150 may not need folds 154, instead relying upon the user to appropriately fold pouch 130 to fit within one of the cavities 106 or 110. Furthermore, in some implementations flexible pouch 150 may be sized to fit within either cavity 106 or 110 without the need for folding.

Flexible pouch 150 may further be equipped with one or more securing flaps 156 to allow items to be secured within flexible pouch 130 and isolated from other items stored within yoga block 100. Securing flaps 156 may further be designed to be secured shut, such as with a zipper mechanism, hook and loop material, or any other suitable closure means.

Figure 5:
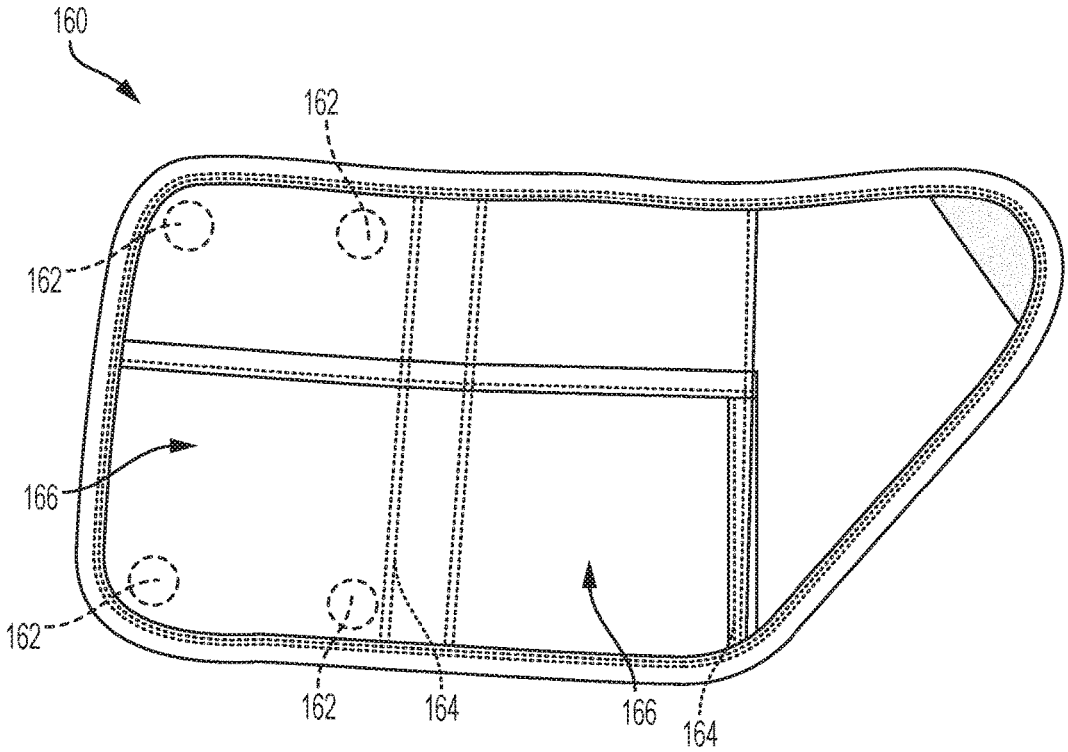
FIG. 5 is an offset frontal view of a second example of a storage pouch that is useful with the yoga block shown in FIG. 1 that can fit internally.

Turning attention to FIG. 5, a second possible embodiment of a flexible pouch, flexible pouch 160, will now be described. Flexible pouch 160 includes many similar or identical features to flexible pouch 150, and shares common a common construction. Thus, for the sake of brevity, each feature of flexible pouch 160 will not be redundantly explained. Rather, key distinctions between flexible pouch 160 and flexible pouch 150 be described in detail and the reader should reference the discussion above for features substantially similar between the two flexible pouches.

As can be seen in FIG. 5, flexible pouch 160 includes attachment points 162, folds 164, and securing flaps 166. Notably, the overall shape of flexible pouch 160 varies from that of flexible pouch 150, along with the configuration of the various securing flaps 166, which comprise a second possible configuration the depiction of flexible pouch 160 securing flap 166 spans across at least one fold 164, increasing its capacity, especially for items such as necklaces that may themselves be flexible, and thus able to span across fold 164.

It should understood that flexible pouches 150 and 160 are but two possible examples and configurations of flexible pouches. A flexible pouch may be configured in any fashion and with any number of different storage options, which can be tailored to specific types of goods to be stored within yoga block 100. For example, a user who needs to store toiletries including liquids may select a flexible pouch that includes waterproof compartments, to contain any accidental leaks. Conversely, a user storing jewelry such as necklaces may desire a pouch configured to keep strand-type jewelry from getting tangled. Other pouch configurations can be utilized for a variety of different personal effects.

Figure 6A:
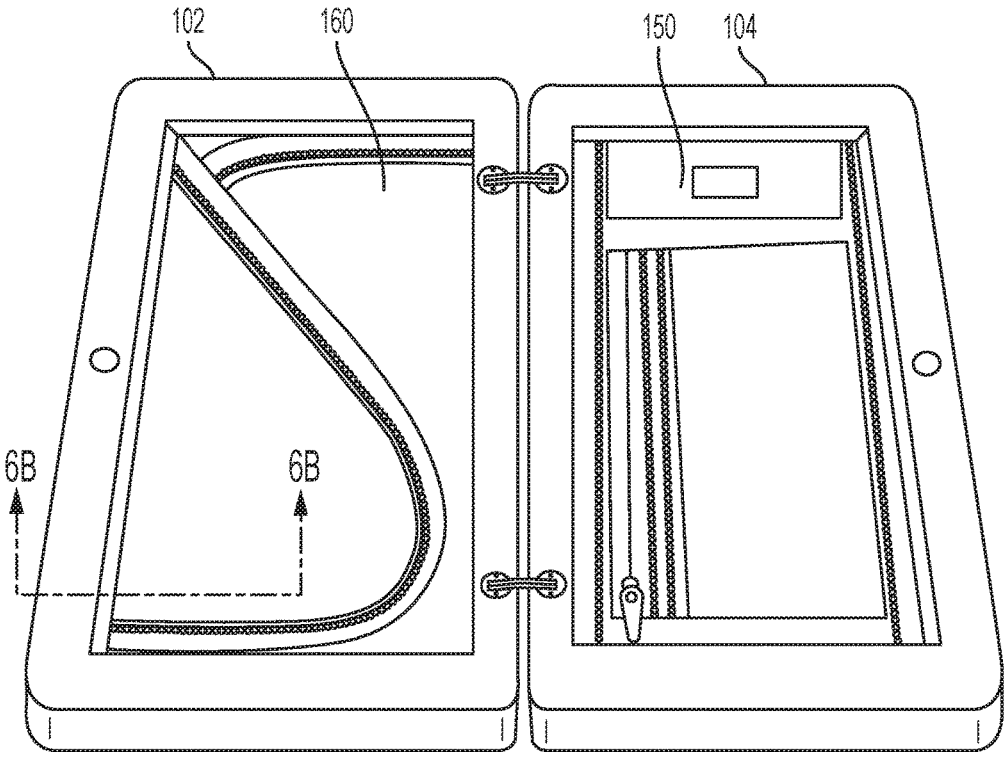
FIG. 6A is an offset overhead perspective view of the yoga block with storage shown in FIG. 1, depicting the first example storage pouch shown in FIG. 4 and the second example storage pouch shown in FIG. 5 in place within the yoga block.

Referring to FIG. 6A, yoga block 100 is depicted with flexible pouch 150 in place within second block half 104 and flexible ouch 160 in place within first block half 102. It will be observed that each flexible pouch is in a folded configuration such that attachment points 152 meet with corresponding attachment points 114 within second block half 104, and attachment points 112 meet with corresponding attachment points 112 within first block half 102.

Figure 6B:
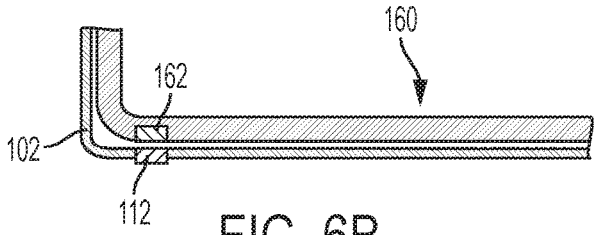
FIG. 6B is a cross-sectional cutaway view of the corner and walls of the yoga block depicted in FIG. 6A, showing the arrangement of an example storage pouch with the walls of the yoga block and associated internal pouch attachment points.

FIG. 6B depicts a cross-section of the bottom and side walls of first block half 102, showing the positioning and interaction between an attachment point 112 with the corresponding attachment point 162 in flexible pouch 160. In this fashion flexible pouch 160 is removably held in place within first block half 102.

By securing items within a flexible pouch, and then securing the flexible pouch within one of the halves of yoga block 100, a user can protect his or her personal effects both from external hazards and theft, but also from damage resulting from items such as keys scratching delicate surfaces of other objects. Items can be inserted by removing a flexible pouch from within yoga block 100 and unfolding it, securing items within one of the securing flaps, folding the pouch, and resecuring it within yoga block 100.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate, one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A yoga block with storage, comprising:

a first block half that includes a first cavity, the first block half being configured to bear the weight of an individual, wherein the first block half comprises:

a first magnet integrated into a first corner of the first cavity;

a second magnet integrated into a second corner of the first cavity;

a third magnet integrated into a third corner of the first cavity;

a fourth magnet integrated into a fourth corner of the first cavity; and a fifth magnet integrated into a first side of the first block half;

a second block half that includes a second cavity, the second block half being configured to bear the weight of the individual, wherein the second block half comprises a sixth magnet integrated into a first side of the second block half, wherein the first side of the first block half corresponds with the first side of the second block half;

an integrated hinge that is removably connected to a second side of the first block half and a second side of the second block half, wherein:

when the first block half and the second block half are in a closed position:

the integrated hinge is hidden such that the integrated hinge does not protrude from an outside of the yoga block when the yoga block is closed; and the first side of the first block half and the first side of the second block half are adjacent to one another, and the second side of the first block half and the second side of the second block half are adjacent to one another;

when the first block half and the second block half are in an open position, the first block half being open at approximately 180 degrees relative to the second block half;

the integrated hinge is configured to disconnect from the second block half so that the first block half is separated from the second block half; and when the first block half and the second block half are in the closed position, the fifth magnet magnetically connects to the sixth magnet to keep the first block half and the second block half in the closed position;

a first flexible pouch with a width that is larger than a width of the first cavity, wherein the first flexible pouch comprises:

a seventh magnet that is configured to magnetically connect to the first magnet;

an eighth magnet that is configured to magnetically connect to the second magnet;

a ninth magnet that is configured to magnetically connect to the third magnet; and a tenth magnet that is configured to magnetically connect to the fourth magnet.

2. The yoga block of claim 1, wherein the fifth magnet magnetically attracts to the sixth magnet to keep the yoga block closed when it is in the closed position.

3. The yoga block of claim 1, wherein the seventh magnet, the eighth magnet, the ninth magnet, and the tenth magnet are configured to removably secure the first flexible pouch within the first cavity.

4. The yoga block of claim 3, wherein the second cavity comprises an eleventh magnet.

5. The yoga block of claim 4, further comprising a second flexible pouch that includes a twelfth magnet that is configured to removably connect the second flexible pouch within the second cavity.

6. The yoga block of claim 3, wherein:

the seventh magnet, the eighth magnet, the ninth magnet, and the tenth magnet are embedded within the first flexible pouch.

* * * * *